US011407618B2

(12) United States Patent
Fan et al.

(10) Patent No.: US 11,407,618 B2
(45) Date of Patent: Aug. 9, 2022

(54) CONTROL SYSTEM AND CONTROL METHOD FOR CONTROLLING START AND STOP OF MULTIPLE PASSENGER CONVEYORS

(71) Applicant: KONE CORPORATION, Helsinki (FI)

(72) Inventors: Jinquan Fan, Kunshan (CN); Zhong Chen, Kunshan (CN)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 17/217,117

(22) Filed: Mar. 30, 2021

(65) Prior Publication Data

US 2021/0309494 A1 Oct. 7, 2021

(30) Foreign Application Priority Data

Apr. 3, 2020 (CN) ..... 202010257929.8

(51) Int. Cl.
*B66B 25/00* (2006.01)
*B66B 21/02* (2006.01)
*B66B 27/00* (2006.01)

(52) U.S. Cl.
CPC ..... *B66B 25/003* (2013.01); *B66B 21/025* (2013.01); *B66B 27/00* (2013.01)

(58) Field of Classification Search
CPC ..... B66B 25/00; B66B 25/003; B66B 21/025; B66B 27/00; B66B 29/005
(Continued)

(56) References Cited

U.S. PATENT DOCUMENTS 6,606,538 B2 * 8/2003 Ponsot ..... B66B 25/00 198/322
10,167,173 B1 * 1/2019 Abuelsaad ..... B66B 25/00
(Continued)

FOREIGN PATENT DOCUMENTS

JP 2007-70061 A 3/2007

OTHER PUBLICATIONS

Extended European Search Report for European Application No. 21166141.8, dated Oct. 21, 2021.

*Primary Examiner* — James R Bidwell
(74) *Attorney, Agent, or Firm* — Birch, Stewart, Kolasch & Birch, LLP

(57) ABSTRACT

A control system and a control method for controlling the start and stop of multiple passenger conveyors are provided. The control system includes a remote camera for capturing images of the corresponding external state of the passenger conveyor in real time; a remote controller for controlling and collecting the operation state of the passenger conveyor; a monitoring server connected with each remote camera and the remote controller through a data network. The monitoring server uses an artificial intelligence algorithm to analyze images captured by the remote camera to determine whether there are passengers on the passenger conveyor; when the monitoring server determines that there are passengers on the passenger conveyor, the passenger conveyor is grouped into a non-automatic start and stop group; when the monitoring server determines that there are no passengers on the passenger conveyor, the passenger conveyor is grouped into an automatic start and stop group.

20 Claims, 3 Drawing Sheets

(58) Field of Classification Search
USPC ..... 198/322, 323, 324
See application file for complete search history.

(56) References Cited

U.S. PATENT DOCUMENTS

| | | | | |
|---|---|---|---|---|
| 10,176,381 | B2 * | 1/2019 | Zhao | G06K 9/00342 |
| 10,427,915 | B2 * | 10/2019 | Gonzalez | B66B 25/00 |
| 10,479,653 | B2 * | 11/2019 | Li | B66B 21/02 |
| 2005/0088520 | A1 * | 4/2005 | Wiesinger | B66B 29/005 348/143 |
| 2011/0025847 | A1 * | 2/2011 | Park | H04N 7/181 348/143 |
| 2013/0140134 | A1 * | 6/2013 | Senger | B66B 25/00 198/322 |
| 2018/0029838 | A1 * | 2/2018 | Fang | B66B 25/003 |

* cited by examiner

CONTROL SYSTEM AND CONTROL METHOD FOR CONTROLLING START AND STOP OF MULTIPLE PASSENGER CONVEYORS

TECHNICAL FIELD

The present disclosure relates to a control system for controlling the start and stop of multiple passenger conveyors and a control method for controlling the start and stop of multiple passenger conveyors.

BACKGROUND

In the prior art, remote inspection of passenger conveyors is provided. A remote inspection device for the passenger conveyor includes: at least one camera, mounted directly above the passenger conveyor for monitoring the external condition of the passenger conveyor; a remote controller, for performing remote visual inspection using the camera; a passenger conveyor controller, for operating the passenger conveyor at a normal speed during normal operation and for operating the passenger conveyor at a slower speed or stopping it completely during remote visual inspection; and a sensor, connected to the passenger conveyor controller and arranged near the entrance of the passenger conveyor for detecting the presence of passengers approaching the entrance of the passenger conveyor.

Based on the prior art, it can be seen that the existing remote inspection system only aims at the remote inspection of a single passenger conveyor, but cannot realize the remote inspection and control of multiple passenger conveyors and lacks corresponding control logic. The existing remote inspection system also lacks safety tips for passengers.

According to the requirements of subway customers, it is necessary to use computers to start and stop the passenger conveyor remotely. This function can significantly reduce the workload of service personnel in subway stations and commercial centers where multiple automatic passenger conveyors are mounted. However, the key way to achieve this goal is to ensure that there are no passengers on the passenger conveyor before starting and stopping, and to establish closed-loop communication between the computer and the controller of the passenger conveyor.

SUMMARY

In order to solve one or more of the above drawbacks in the prior art, according to one aspect of the present disclosure, a control system for controlling the start and stop of a plurality of passenger conveyors is provided. For example, a plurality of passenger conveyors distributed at different positions.

The control system includes a remote camera and a remote controller corresponding to each of the plurality of passenger conveyors.

The control system also includes a monitoring server.

The monitoring server automatically issues start and stop instructions at a predetermined time.

The remote camera is used for capturing images of the corresponding external state of the passenger conveyor in real time.

The remote controller is arranged to control and collect the operation state of the corresponding passenger conveyor.

The monitoring server is connected with each remote camera and the remote controller through a data network.

The monitoring server uses the artificial intelligence algorithm to analyze the images captured by the remote camera to determine whether there are passengers on the passenger conveyor.

When the monitoring server determines that there are passengers on the corresponding passenger conveyor, the passenger conveyor is grouped into non-automatic start and stop group.

When the monitoring server determines that there are no passengers on the corresponding passenger conveyor, the passenger conveyor is grouped into automatic start and stop group.

The number of passenger conveyors in the non-automatic start and stop group and the automatic start and stop group is dynamically changed.

According to the above embodiments of the present disclosure, the control system includes a data transmission unit corresponding to each of the plurality of passenger conveyors.

The monitoring server is connected with each data transmission unit through the data network.

The data transmission unit is arranged to receive the state data about the operation state of the corresponding passenger conveyor collected by the remote controller.

According to the above embodiments of the present disclosure, the control system also includes an alarm device corresponding to each of the plurality of passenger conveyors.

The monitoring server is connected with each alarm device through the data network.

According to the above embodiments of the present disclosure, the monitoring server will not issue start and stop instructions to the remote controller corresponding to the passenger conveyor grouped into the non-automatic start and stop group.

According to the above embodiments of the present disclosure, the remote camera continues to capture images of the external state of the passenger conveyor grouped into the non-automatic start and stop group in real time.

When the monitoring server determines that there are no passengers on the passenger conveyor grouped into the non-automatic start and stop group based on the image, the monitoring server sends the start and stop instruction, the remote controller receives the start and stop instruction and controls the start and stop of the passenger conveyor.

According to the above embodiments of the present disclosure, the monitoring server sends start and stop instructions to the remote controller corresponding to the passenger conveyor grouped into the automatic start and stop group, and the remote controller receives the start and stop instructions and controls the start and stop of the passenger conveyor.

According to the above embodiments of the present disclosure, the alarm device is arranged to give an alarm to the passenger, so as to prompt the passenger to leave the passenger conveyor or not enter the passenger conveyor within a certain time range.

According to the above embodiments of the present disclosure, after the alarm device sends out the alarm for a certain time, the remote camera continues to capture images of the external state of the passenger conveyor grouped into the automatic start and stop group in real time.

When the monitoring server determines that there are no passengers on the passenger conveyor grouped into the automatic start and stop group based on the image, the monitoring server sends the start and stop instruction, the remote controller receives the start and stop instruction and controls the start and stop of the passenger conveyor.

When the monitoring server determines that there are passengers on the passenger conveyor grouped into the automatic start and stop group based on the image, the monitoring server will not issue the start and stop instructions.

According to the above embodiments of the present disclosure, after the monitoring server sends the start instruction and the remote controller receives the start instruction and controls the start of the passenger conveyor, if the remote controller determines that the passenger conveyor has not accelerated to the normal operation speed, the passenger conveyor is grouped into the non-automatic start group.

After the monitoring server issues a stop instruction and the remote controller receives the stop instruction and controls the passenger conveyor to stop, if the remote controller determines that the passenger conveyor has not slowed down or stopped, the passenger conveyor is grouped into non-automatic stop group.

If the remote controller determines that the passenger conveyor accelerates to the normal operation speed or if the remote controller determines that the passenger conveyor decelerates or stops, the data transmission unit is set to receive the state data about the current operation state of the corresponding passenger conveyor collected by the remote controller.

If the data transmission unit transmits the state data to the monitoring server, the control system prepares the next corresponding auto start and auto stop operation.

If the data transmission unit does not transmit the state data to the monitoring server, the corresponding passenger conveyors are grouped into non-automatic start and stop group.

According to the above embodiments of the present disclosure, the monitoring server includes a human-computer interaction device for displaying the state data.

According to another aspect of the present disclosure, a control method for controlling the start and stop of a plurality of passenger conveyors is provided, the start and stop are controlled by the control system.

The control system includes a remote camera, a remote controller, a data transmission unit and an alarm device corresponding to each of the plurality of passenger conveyors.

The control system also includes a monitoring server.

The remote camera is set to capture an image of the external state of the corresponding passenger conveyor in real time.

Setting the remote controller to control and collect the operation state of the corresponding passenger conveyor.

Connecting the monitoring server with each remote camera and the remote controller through a data network.

The monitoring server automatically issues start and stop instructions at a predetermined time.

The monitoring server uses the artificial intelligence algorithm to analyze the images captured by the remote camera to determine whether there are passengers on the passenger conveyor.

When the monitoring server determines that there are passengers on the corresponding passenger conveyor, the passenger conveyor is grouped into non-automatic start and stop group.

When the monitoring server determines that there are no passengers on the corresponding passenger conveyor, the passenger conveyor is grouped into automatic start and stop group.

The control method according to the above embodiments of the present disclosure, connecting the monitoring server with each data transmission unit through the data network.

The data transmission unit is set to receive the state data about the operation state of the corresponding passenger conveyor collected by the remote controller.

The control method according to the above embodiments of the present disclosure, the monitoring server is connected with each alarm device through the data network.

The control method according to the above embodiments of the present disclosure, the monitoring server will not issue start and stop instructions to the remote controller corresponding to the passenger conveyor grouped into the non-automatic start and stop group.

The control method according to the above embodiments of the present disclosure, the remote camera continues to capture images of the external state of the passenger conveyor grouped into the non-automatic start and stop group in real time.

When the monitoring server determines that there are no passengers on the passenger conveyor grouped into the non-automatic start and stop group based on the image, the monitoring server sends the start and stop instruction, the remote controller receives the start and stop instruction and controls the start and stop of the passenger conveyor.

The control method according to the above embodiments of the present disclosure, the monitoring server sends start and stop instructions to the remote controller corresponding to the passenger conveyor grouped into the automatic start and stop group, and the remote controller receives the start and stop instructions and controls the start and stop of the passenger conveyor.

The control method according to the above embodiments of the present disclosure, the alarm device is arranged to give an alarm to the passenger, so as to prompt the passenger to leave the passenger conveyor or not enter the passenger conveyor within a certain time range.

The control method according to the above embodiments of the present disclosure, after the alarm device sends out the alarm for a certain time, the remote camera continues to capture images of the external state of the passenger conveyor grouped into the automatic start and stop group in real time.

When the monitoring server determines that there are no passengers on the passenger conveyor grouped into the automatic start and stop group based on the image, the monitoring server sends the start and stop instruction, the remote controller receives the start and stop instruction and controls the start and stop of the passenger conveyor.

When the monitoring server determines that there are passengers on the passenger conveyor grouped into the automatic start and stop group based on the image, the monitoring server will not issue the start and stop instructions.

The control method according to the above embodiments of the present disclosure, after the monitoring server sends the start instruction and the remote controller receives the start instruction and controls the start of the passenger conveyor, if the remote controller determines that the passenger conveyor has not accelerated to the normal operation speed, the passenger conveyor is grouped into the non-automatic start group.

After the monitoring server issues a stop instruction and the remote controller receives the stop instruction and controls the passenger conveyor to stop, if the remote controller determines that the passenger conveyor has not slowed down or stopped, the passenger conveyor is grouped into non-automatic stop group.

If the remote controller determines that the passenger conveyor accelerates to the normal operation speed or if the remote controller determines that the passenger conveyor decelerates or stops, the data transmission unit is set to receive the state data about the current operation state of the corresponding passenger conveyor collected by the remote controller.

If the data transmission unit transmits the state data to the monitoring server, the control system prepares the next corresponding auto start and auto stop operation.

If the data transmission unit does not transmit the state data to the monitoring server, the corresponding passenger conveyors are grouped into non-automatic start and stop group.

The control method according to the above embodiments of the present disclosure, said monitoring server includes a human-computer interaction device, said human-computer interaction device being used to display said state data.

According to the control system and the control method of the present disclosure, remote inspection on a plurality of passenger conveyors is realized, and the control logic is that: after a start instruction and a stop instruction are automatically issued by a monitoring server at a predetermined time, the monitoring server uses an artificial intelligence algorithm to analyze images captured by a remote camera to determine whether passengers exist on the passenger conveyors, when the monitoring server determines that there are passengers on the corresponding passenger conveyors, the passenger conveyors are grouped into non-automatic start and stop group so as not to be automatically started and stopped, while when the monitoring server determines that there are no passengers on the corresponding passenger conveyors, the passenger conveyors are grouped into automatic start and stop group so as to be automatically started and stopped.

So far, in order that the detailed description of the present disclosure can be better understood and the contribution of the present disclosure to the prior art can be better recognized, the present disclosure has summarized the content of the present disclosure quite broadly. Of course, embodiments of the present disclosure will be described below and will form the subject matter of the appended claims.

Likewise, those skilled in the art will recognize that the concepts on which the present disclosure is based can be easily used as a basis for designing other structures, methods and systems for carrying out several purposes of the present disclosure. Therefore, it is important that the appended claims should be considered to include such equivalent structures as long as they do not go beyond the spirit and scope of the present disclosure.

BRIEF DESCRIPTION OF THE DRAWINGS

Those skilled in the art will have a better understanding of the present disclosure through the following drawings, and the advantages of the present disclosure can be more clearly reflected. The drawings described herein are only for illustrative purposes of selected embodiments, not all possible implementations and are intended not to limit the scope of the present disclosure.

DETAILED DESCRIPTION

Hereafter, the specific embodiments of the present disclosure will be described in detail with reference to the accompanying drawings.

Figure 1:
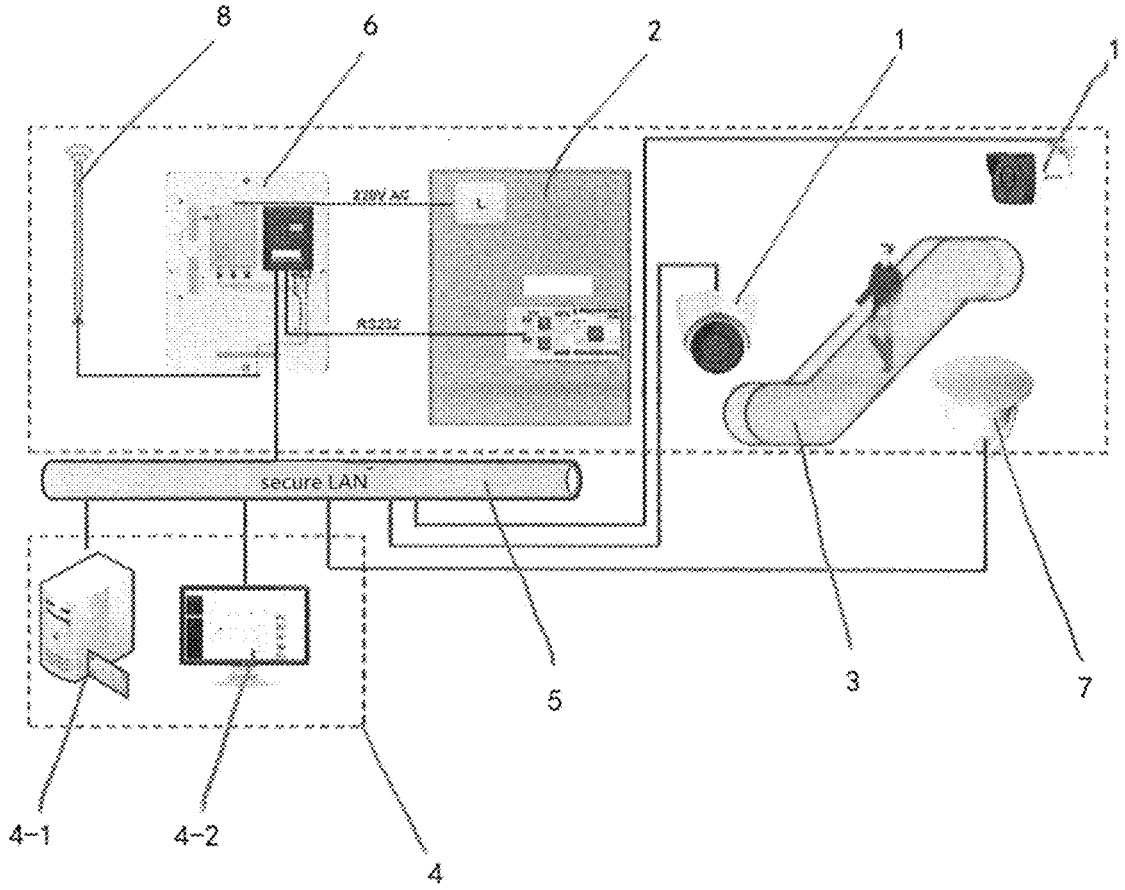
FIG. 1 illustrates a schematic diagram of a control system for controlling the start and stop of a plurality of passenger conveyors according to the present disclosure.

FIG. 1 illustrates a schematic diagram of a control system for controlling the start and stop of a plurality of passenger conveyors according to the present disclosure. The general idea of the present disclosure is that the control system includes a remote camera 1 and a remote controller 2 respectively provided for each passenger conveyor 3 of the plurality of passenger conveyors (only one passenger conveyor is illustrated in FIG. 1 for the sake of brevity).

The control system also includes a monitoring server 4.

The monitoring server 4 automatically issues a start instruction and a stop instruction at different predetermined times, such as but not limited to issuing a start instruction at 6:00 in the morning and a stop instruction at 23:00 in the evening.

The remote camera 1 is used for capturing images of the external state of the corresponding passenger conveyor 3 in real time.

The remote controller 2 is arranged to control and collect the operation state of the corresponding passenger conveyor 3.

The monitoring server 4 is connected with each of the remote cameras 1 and the remote controllers 2 through a data network 5. The data network 5 is, for example but not limited to, a secure local area network based on TCP/IP protocol. The remote camera 1 is, for example but not limited to, a network camera 1.

The monitoring server uses an artificial intelligence algorithm (e.g., an artificial intelligence algorithm run by an artificial intelligence computing device) to analyze the images captured by the remote camera 1 to determine whether there are passengers on the passenger conveyor 3.

When the monitoring server 4 determines that there are passengers on the corresponding passenger conveyors 3, the passenger conveyor is grouped into a non-automatic start and stop group. This means that the passenger conveyor will not be automatically started and stopped, thus protecting passengers.

When the monitoring server 4 determines that there are no passengers on the corresponding passenger conveyors 3, the passenger conveyor is grouped into an automatic start and stop group.

When the passenger conveyor grouped into the non-automatic start and stop group is re-detected that there are no passengers on them, the passenger conveyor can be grouped into the automatic start and stop group.

The number of passenger conveyors in the non-automatic start and stop group and the automatic start and stop group is dynamically changed.

According to the above embodiments of the present disclosure, the control system includes a data transmission unit 6 respectively provided corresponding to each of the plurality of passenger conveyors 3.

The monitoring server 4 is connected with each data transmission unit 6 through the data network 5.

The data transmission unit 6 is arranged to receive the state data about the operation state of the corresponding passenger conveyor 3 collected by the remote controller 2 and send the state data to the monitoring server 4.

The data transmission unit 6 is also arranged to receive the automatic start and stop instruction sent by the monitoring server 4 and send the automatic start and stop instruction to the remote controller 2.

According to the above embodiments of the present disclosure, the control system further includes an alarm device 7 respectively provided corresponding to each of the plurality of passenger conveyors.

The monitoring server 4 is connected with each alarm device 7 through the data network 5.

According to the control system of the above embodiments of the present disclosure, the monitoring server 4 will not issue start and stop instructions to the remote controller 2 corresponding to the passenger conveyors 3 grouped into the non-automatic start and stop group.

According to the control system of the above embodiments of the present disclosure, the remote camera 7 continues to capture images of the external state of the passenger conveyor 3 grouped into the non-automatic start and stop group in real time.

When the monitoring server 4 determines that there are no passengers on the corresponding passenger conveyor 3 grouped into the non-automatic start and stop group based on the image, the monitoring server 4 issues a start and stop instruction, and the remote controller 2 receives the start and stop instruction and controls the passenger conveyor 3 to start and stop. This also means that the passenger conveyor that did not have automatic start and stop conditions can be automatically started and stopped again.

According to the control system of the above embodiments of the present disclosure, the monitoring server 4 issues start and stop instructions to the remote controller 2 corresponding to the passenger conveyor 3 grouped into the automatic start and stop group, and the remote controller 2 receive the start and stop instructions and control the start and stop of the passenger conveyors 3.

According to the control system of the above embodiments of the present disclosure, the alarm device 7 is arranged to give an alarm to passengers, so as to prompt the passengers to leave the passenger conveyor 3 or not to enter the passenger conveyor 3 within a certain time range.

According to the control system of the above embodiments of the present disclosure, after the alarm device 7 sends out an alarm for a certain time, the remote camera 1 continues to capture images of the external state of the passenger conveyor grouped into the automatic start and stop group in real time.

When the monitoring server 4 determines that there are no passengers on the corresponding passenger conveyor 3 grouped into the automatic start and stop group based on the image, the monitoring server 4 issues start and stop instructions, and the remote controller 2 receives the start and stop instructions and controls the start and stop of the passenger conveyors 3.

When the monitoring server 4 determines that there are passengers on the corresponding passenger conveyor 3 grouped into the automatic start and stop group based on the image, the monitoring server 4 will not issue a start and stop instruction.

According to the control system of the above embodiments of the present disclosure, after the monitoring server 4 sends a start instruction and the remote controller 2 receives the start instruction and controls the passenger conveyor 3 to start, if the remote controller 4 determines that the passenger conveyor 3 has not accelerated to the normal operation speed, the passenger conveyor 3 is grouped into a non-automatic start group.

When the passenger conveyor grouped into the non-automatic start group is re-detected to accelerate to a normal running speed, the passenger conveyor can be grouped into an automatic start group.

After the monitoring server 4 issues a stop instruction and the remote controller 2 receives the stop instruction and controls the passenger conveyor 3 to stop, if the remote controller 2 determines that the passenger conveyor 3 has not slowed down or stopped, the passenger conveyor 3 is grouped into a non-automatic stop group.

When the passenger conveyor grouped into the non-automatic stop group is re-detected to slow down or stop, the passenger conveyor can be grouped into an automatic stop group.

If the remote controller 2 determines that the passenger conveyor 3 accelerates to the normal operation speed or if the remote controller 2 determines that the passenger conveyor 3 decelerates or stops, the data transmission unit 6 is set to receive state data collected by the remote controller 2 about the current operation state of the corresponding passenger conveyor 3.

The data transmission unit 6 is also arranged to transmit the state data to portable electronic equipment carried by elevator maintenance personnel through an antenna 8. Elevator maintenance personnel can clearly know the operation state of each passenger conveyor through the application programs running on the portable electronic equipment.

If the data transmission unit 6 transmits the state data to the monitoring server 4, the control system re-prepares for the next corresponding automatic start operation.

If the data transmission unit 6 does not transmit the state data to the monitoring server 4, the corresponding passenger conveyors are grouped into the non-automatic start and stop group.

According to the control system of the above embodiments of the present disclosure, the monitoring server 4 includes a human-computer interaction device 4-2 for displaying the state data.

Figure 2:
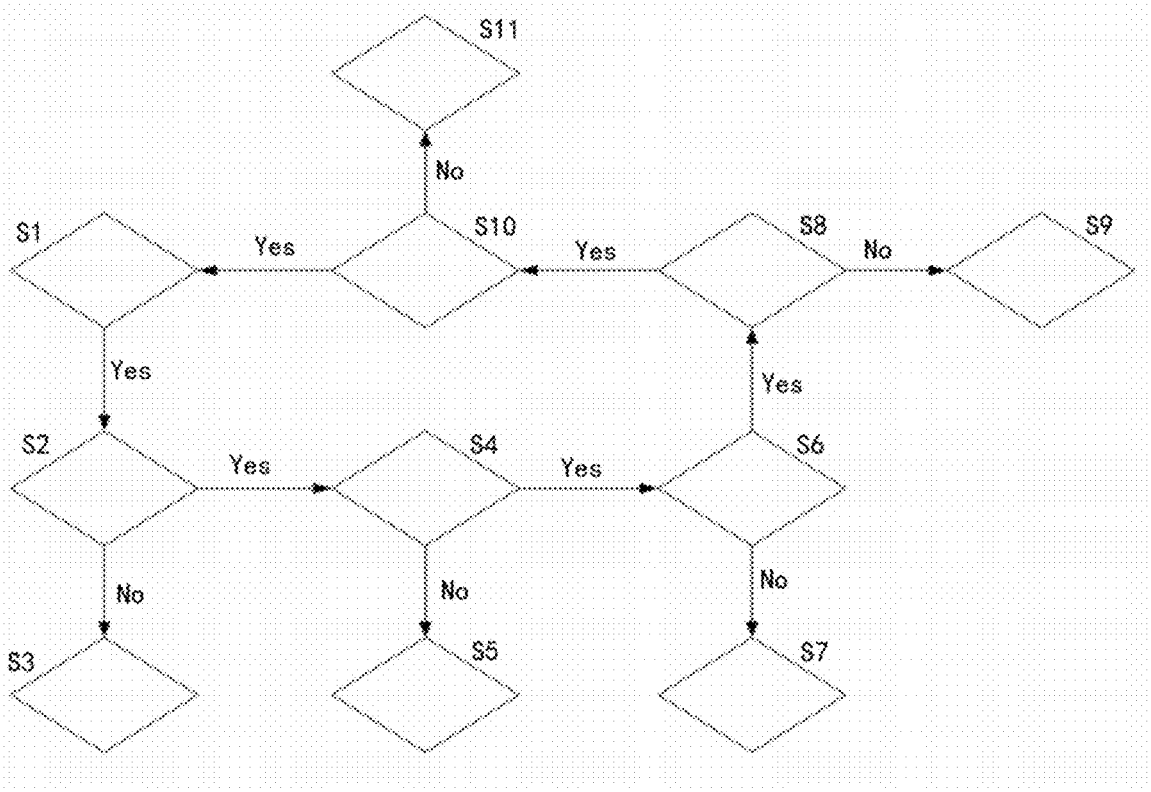
FIG. 2 illustrates a schematic diagram of a control method for controlling the start of a plurality of passenger conveyors according to the present disclosure.
Figure 3:
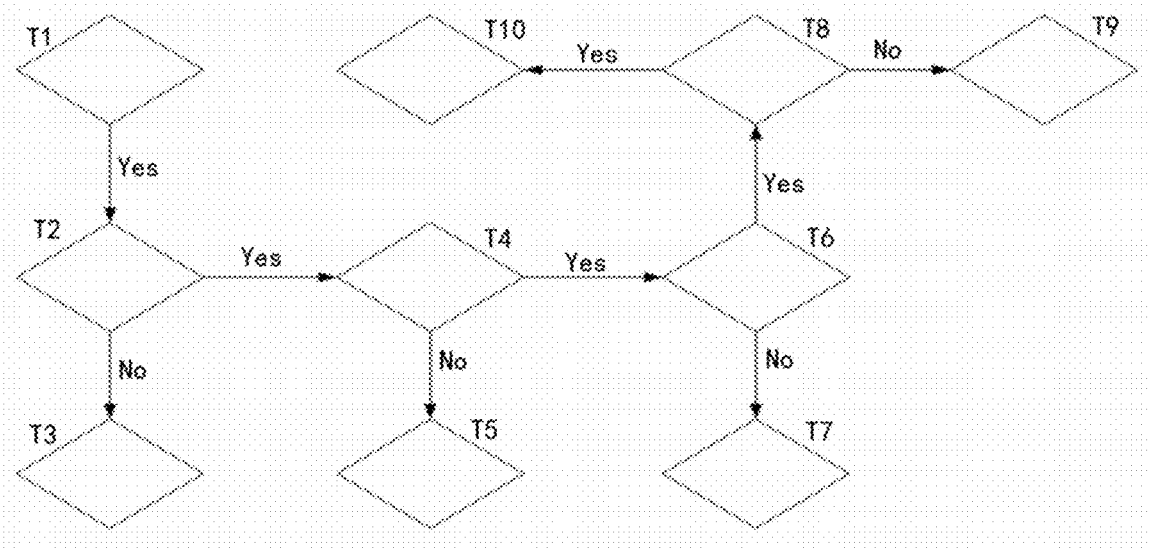
FIG. 3 illustrates a schematic diagram of a control method for controlling the stop of a plurality of passenger conveyors according to the present disclosure.

In another embodiment of the present disclosure, as illustrated in FIGS. 2 and 3, schematic diagrams of a control method for controlling the start and stop of a plurality of passenger conveyors are respectively illustrated.

The start and stop are controlled by the control system as described above.

The control system includes a remote camera 1, a remote controller 2, a data transmission unit 6 and an alarm device 7 which are respectively arranged corresponding to each passenger conveyor 3 of the plurality of passenger conveyors.

The control system also includes a monitoring server 4.

Setting the remote camera 1 to capture an image of the external state of the corresponding passenger conveyor 3 in real time.

Setting the remote controller 2 to control and collect the operation state of the corresponding passenger conveyor 3.

Connecting the monitoring server 4 with each of the remote cameras 1 and the remote controller 2 through a data network 5.

The monitoring server 4 automatically issues a start instruction and a stop instruction at a predetermined time, such as but not limited to issuing a start instruction at 6:00 in the morning and a stop instruction at 23:00 in the evening.

The monitoring server 4 uses the artificial intelligence algorithm to analyze the images captured by the remote camera 1 to determine whether there are passengers on the passenger conveyor 3.

When the monitoring server 4 determines that there are passengers on the corresponding passenger conveyor 3, the passenger conveyor is grouped into a non-automatic start and stop group.

When the monitoring server 4 determines that there are no passengers on the corresponding passenger conveyor 3, the passenger conveyor is grouped into an automatic start and stop group.

When the passenger conveyor grouped into the non-automatic start and stop group is re-detected that there are no passengers on it, the passenger conveyor can be grouped into the automatic start and stop group.

According to the control method of the above embodiment of the present disclosure, the monitoring server 4 is connected with each of the data transmission units 6 through the data network 5.

The data transmission unit 6 is set to receive the state data about the operation state of the corresponding passenger conveyor 3 collected by the remote controller 2 and send the state data to the monitoring server 4.

The data transmission unit 6 is also set to receive the automatic start and stop instruction sent by the monitoring server 4 and send the automatic start and stop instruction to the remote controller 2.

According to the control method of the above embodiments of the present disclosure, the monitoring server 4 is connected with each of the alarm devices 7 through the data network 5.

According to the control method of the above embodiments of the present disclosure, the monitoring server 4 will not issue start and stop instructions to the remote controller 2 corresponding to the passenger conveyor grouped into the non-automatic start and stop group.

According to the control method of the above embodiments of the present disclosure, the remote camera 1 continues to capture images of the external state of the passenger conveyor grouped into the non-automatic start and stop group in real time.

When the monitoring server 4 determines that there are no passengers on the corresponding passenger conveyor grouped into the non-automatic start and stop group based on the image, the monitoring server 4 issues start and stop instructions, and the remote controller 2 receives the start and stop instructions and controls the start and stop of the passenger conveyors.

According to the control method of the above embodiments of the present disclosure, the monitoring server 4 sends start and stop instructions to the remote controller 2 corresponding to the passenger conveyor grouped into the automatic start and stop group, and the remote controller 2 receives the start and stop instructions and controls the start and stop of the passenger conveyor.

According to the control method of the above embodiments of the present disclosure, the alarm device 7 is arranged to give an alarm to passengers, so as to prompt the passengers to leave the passenger conveyor or not to enter the passenger conveyor within a certain time range.

According to the control method of the above embodiments of the present disclosure, after the alarm device 7 issues an alarm for the certain time, the remote camera 1 continues to capture images of the external state of the passenger conveyor grouped into the automatic start and stop group in real time.

When the monitoring server 4 determines that there are no passengers on the corresponding passenger conveyor grouped into the automatic start and stop group based on the image, the monitoring server 4 issues start and stop instructions, and the remote controller 2 receives the start and stop instructions and controls the start and stop of the passenger conveyor.

When the monitoring server 4 determines that there are passengers on the corresponding passenger conveyor grouped into the automatic start and stop group based on the image, the monitoring server 4 will not issue a start and stop instruction.

According to the control method of the above embodiments of the present disclosure, after the monitoring server 4 sends a start instruction and the remote controller 2 receives the start instruction and controls the passenger conveyor to start, if the remote controller 2 determines that the passenger conveyor has not accelerated to the normal operation speed, the passenger conveyor is grouped into a non-automatic start group.

When the passenger conveyor grouped into the non-automatic start group is re-detected to accelerate to the normal operation speed, the passenger conveyor can be grouped into an automatic start group.

After the monitoring server 4 issues a stop instruction and the remote controller 2 receives the stop instruction and controls the passenger conveyor to stop, if the remote controller 2 determines that the passenger conveyor has not slowed down or stopped, the passenger conveyor is grouped into a non-automatic stop group.

When the passenger conveyor grouped into the non-automatic stop group is re-detected to slow down or stop, the passenger conveyor can be grouped into the automatic stop group.

If the remote controller 2 determines that the passenger conveyor accelerates to the normal operation speed or if the remote controller 2 determines that the passenger conveyor decelerates or stops, the data transmission unit 6 is set to receive state data collected by the remote controller 2 about the current operation state of the corresponding passenger conveyor.

If the data transmission unit 6 transmits the state data to the monitoring server 4, the control system re-prepares the next corresponding automatic start operation.

If the data transmission unit 6 does not transmit the state data to the monitoring server 4, the corresponding passenger conveyors are grouped into the non-automatic start and stop group.

According to the control method of the above embodiments of the present disclosure, the monitoring server 4 includes a human-computer interaction device 4-2, the human-computer interaction device 4-2 is used to display the state data.

A control method for controlling the start of a plurality of passenger conveyors according to an embodiment of the present disclosure will be described with reference to FIG. 2.

Step S1: the monitoring server 4 automatically sends a start instruction at a predetermined time.

Step S2: the monitoring server 4 uses the artificial intelligence algorithm to analyze the images captured by the remote camera 1 to determine whether there are passengers on the passenger conveyor 3 (whether on the elevator pedal and at the entrance and exit).

When the monitoring server 4 determines that there are passengers on the corresponding passenger conveyor 3, the passenger conveyor is grouped into the non-automatic start group (Step S3); the monitoring server 4 will not send a start instruction to the remote controller 2 corresponding to the passenger conveyor grouped into the non-automatic start group.

When the monitoring server 4 determines that there are no passengers on the corresponding passenger conveyor 3, the passenger conveyor is grouped into the automatic start group.

Step S4: the alarm device 7 is set to give an alarm to the passengers, so as to prompt the passengers to leave the passenger conveyor or not enter the passenger conveyor within a certain time range.

After the alarm device 7 gives an alarm for a certain time (for example, but not limited to 10 seconds), the remote camera 1 continues to capture images of the external state of the passenger conveyor grouped into the automatic start group in real time.

When the monitoring server 4 determines that there are no passengers on the corresponding passenger conveyor grouped into the automatic start group based on the image, the monitoring server 4 issues a start instruction, and the remote controller 2 receives the start instruction and controls the passenger conveyor to start (Step S6).

When the monitoring server 4 determines that there are passengers on the corresponding passenger conveyor grouped into the automatic start group based on the image, the passenger conveyor is grouped into the non-automatic start group (Step S5), and the monitoring server 4 will not send a start instruction to it.

Step S6: if the passenger conveyor is not started, it can be started by a manual start device (Step S7).

Step S8: after the monitoring server 4 sends the start instruction and the remote controller 2 receives the start instruction and controls the passenger conveyor to start, if the remote controller 2 determines that the passenger conveyor does not run at a slow speed and then accelerates to a normal operation speed, the passenger conveyor is grouped into the non-automatic start group (Step S9).

If the remote controller 2 determines that the passenger conveyor runs at a slow speed and then accelerates to a normal operation speed, the data transmission unit 6 is set to receive the state data collected by the remote controller 2 about the corresponding current operation state of the passenger conveyor, at this time, if the data transmission unit 6 transmits the state data to the monitoring server 4 (Step S10), the control system re-prepares the next corresponding automatic start operation (Step S1). If the data transmission unit 6 does not transmit the state data to the monitoring server 4, the corresponding passenger conveyor is grouped into the non-automatic start group (Step S11).

A control method for controlling the stop of a plurality of passenger conveyors according to an embodiment of the present disclosure will be described with reference to FIG. 3.

Step T1: the monitoring server 4 automatically issues a stop instruction at a predetermined time.

Step T2: the monitoring server 4 uses the artificial intelligence algorithm to analyze the image captured by the remote camera 1 to determine whether there are passengers on the passenger conveyor 3 (whether on the elevator pedal and at the entrance and exit).

When the monitoring server 4 determines that there are passengers on the corresponding passenger conveyor 3, the passenger conveyor is grouped into the non-automatic stop group (Step T3). The monitoring server 4 will not issue a stop instruction to the remote controller 2 corresponding to the passenger conveyor grouped into the non-automatic stop group.

When the monitoring server 4 determines that there are no passengers on the corresponding passenger conveyor 3, the passenger conveyor is grouped into the automatic stop group.

Step T4: the alarm device 7 is set to give an alarm to the passengers, so as to prompt the passengers to leave the passenger conveyor or not enter the passenger conveyor within a certain time range.

After the alarm device 7 gives an alarm for a certain time (for example, but not limited to 10 seconds), the remote camera 1 continues to capture images of the external state of the passenger conveyor grouped into the automatic stop group in real time.

When the monitoring server 4 determines that there are no passengers on the corresponding passenger conveyor grouped into the automatic stop group based on the image, the monitoring server 4 issues a stop instruction, and the remote controller 2 receives the stop instruction and controls the passenger conveyors to stop (Step T6).

When the monitoring server 4 determines that there are passengers on the corresponding passenger conveyor grouped into the automatic stop group based on the image, the passenger conveyor is grouped into the non-automatic stop group (Step T5), and the monitoring server 4 will not issue a stop instruction to it.

Step T6: if the passenger conveyor is not stopped, it can be stopped by a manual stop device (Step T7).

Step T8: after the monitoring server 4 sends a stop instruction and the remote controller 2 receives the stop instruction and controls the passenger conveyor to stop, if the remote controller 2 determines that the passenger conveyor has not slowed down or stopped, the passenger conveyor is grouped into a non-automatic stop group (Step T9).

If the remote controller 2 determines that the passenger conveyor slows down or stops, the data transmission unit 6 is set to receive the state data about the corresponding current operation state of the passenger conveyor collected by the remote controller 2, and the data transmission unit 6 transmits the state data to the monitoring server 4 (step T10), and the control system re-prepares the next corresponding automatic start operation.

With reference to specific embodiments, although the present disclosure has been described in the specification and drawings, it should be understood that various changes can be made by those skilled in the art without departing from the scope of the present disclosure as defined in the claims, and various equivalents can be substituted for various elements therein. Furthermore, the combination and collocation of technical features, elements and/or functions among specific embodiments in the present disclosure are clear, so according to these disclosures, those skilled in the art can appreciate that the technical features, elements and/or functions of an embodiment can be combined into another specific embodiment as appropriate, unless otherwise described above. In addition, according to the teaching of the present disclosure, many changes can be made to adapt to special situations or materials without departing from the scope of the essence of the present disclosure. Therefore, the present disclosure is not limited to the specific embodiments illustrated in the drawings and the specific embodiments described in the specification as the best mode presently contemplated for carrying out the present disclosure, but the present disclosure is intended to include all embodiments falling within the scope of the above description and the appended claims.

The invention claimed is:

1. A control system for controlling the start and stop of multiple passenger conveyors, wherein the control system includes a remote camera and a remote controller corresponding to each of the plurality of passenger conveyors;

the control system also includes a monitoring server;

the monitoring server automatically issues start and stop instructions at a predetermined time;

the remote camera is used for capturing images of an external state of a corresponding passenger conveyor in real time;

the remote controller is arranged to control and collect an operation state of the corresponding passenger conveyor;

the monitoring server is connected with each remote camera and the remote controller through a data network;

the monitoring server uses an artificial intelligence algorithm to analyze the images captured by the remote camera to determine whether there are passengers on the passenger conveyor;

when the monitoring server determines that there are passengers on the corresponding passenger conveyor, the passenger conveyor is grouped into a non-automatic start and stop group;

when the monitoring server determines that there are no passengers on the corresponding passenger conveyor, the passenger conveyor is grouped into an automatic start and stop group.

2. The control system according to claim 1, wherein the control system includes a data transmission unit corresponding to each of the plurality of passenger conveyors;

the monitoring server is connected with each data transmission unit through the data network;

the data transmission unit is arranged to receive state data about the operation state of the corresponding passenger conveyor collected by the remote controller.

3. The control system according to claim 2, wherein the control system also includes an alarm device corresponding to each of the plurality of passenger conveyors;

the monitoring server is connected with each alarm device through the data network.

4. The control system according to claim 3, wherein the monitoring server will not issue start and stop instructions to the remote controller corresponding to the passenger conveyor grouped into the non-automatic start and stop group.

5. The control system according to claim 4, wherein the remote camera continues to capture images of the external state of the passenger conveyor grouped into the non-automatic start and stop group in real time;

when the monitoring server determines that there are no passengers on the passenger conveyor grouped into the non-automatic start and stop group based on the image, the monitoring server sends the start and stop instruction, the remote controller receives the start and stop instruction and controls the start and stop of the passenger conveyor.

6. The control system according to claim 3, wherein the monitoring server sends start and stop instructions to the remote controller corresponding to the passenger conveyor grouped into the automatic start and stop group, and the remote controller receives the start and stop instructions and controls the start and stop of the passenger conveyor.

7. The control system according to claim 3, wherein the alarm device is arranged to give an alarm to the passenger, so as to prompt the passenger to leave the passenger conveyor or not enter the passenger conveyor within a certain time range.

8. The control system of claim 7, wherein after the alarm device sends out the alarm for a certain time, the remote camera continues to capture images of the external state of the passenger conveyor grouped into the automatic start and stop group in real time;

when the monitoring server determines that there are no passengers on the passenger conveyor grouped into the automatic start and stop group based on the image, the monitoring server sends the start and stop instruction, the remote controller receives the start and stop instruction and controls the start and stop of the passenger conveyor;

when the monitoring server determines that there are passengers on the passenger conveyor grouped into the automatic start and stop group based on the image, the monitoring server will not issue the start and stop instructions.

9. The control system according to claim 6, wherein after the monitoring server sends the start instruction and the remote controller receives the start instruction and controls the start of the passenger conveyor, if the remote controller determines that the passenger conveyor has not accelerated to the normal operation speed, the passenger conveyor is grouped into a non-automatic start group;

after the monitoring server issues a stop instruction and the remote controller receives the stop instruction and controls the passenger conveyor to stop, if the remote controller determines that the passenger conveyor has not slowed down or stopped, the passenger conveyor is grouped into a non-automatic stop group;

if the remote controller determines that the passenger conveyor accelerates to the normal operation speed or if the remote controller determines that the passenger conveyor decelerates or stops, the data transmission unit is set to receive the state data about the current operation state of the corresponding passenger conveyor collected by the remote controller;

if the data transmission unit transmits the state data to the monitoring server, the control system prepares the next corresponding auto start and auto stop operation;

if the data transmission unit does not transmit the state data to the monitoring server, the corresponding passenger conveyors are grouped into the non-automatic start and stop group.

10. The control system of claim 9, wherein the monitoring server includes a human-computer interaction device for displaying the state data.

11. A control method for controlling the start and stop of multiple passenger conveyors, wherein the start and stop are controlled by a control system;

the control system includes a remote camera, a remote controller, a data transmission unit and an alarm device corresponding to each of the plurality of passenger conveyors;

the control system also includes a monitoring server;

the remote camera is set to capture an image of an external state of the corresponding passenger conveyor in real time;

setting the remote controller to control and collect an operation state of the corresponding passenger conveyor;

connecting the monitoring server with each remote camera and the remote controller through a data network;

the monitoring server automatically issues start and stop instructions at a predetermined time;

the monitoring server uses an artificial intelligence algorithm to analyze the images captured by the remote camera to determine whether there are passengers on the passenger conveyor;

when the monitoring server determines that there are passengers on the corresponding passenger conveyor, the passenger conveyor is grouped into a non-automatic start and stop group;

when the monitoring server determines that there are no passengers on the corresponding passenger conveyor, the passenger conveyor is grouped into an automatic start and stop group.

12. The control method according to claim 11, wherein connecting the monitoring server with each data transmission unit through the data network;

the data transmission unit is set to receive state data about the operation state of the corresponding passenger conveyor collected by the remote controller.

13. The control method according to claim 12, wherein the monitoring server is connected with each alarm device through the data network.

14. The control method according to claim 13, wherein the monitoring server will not issue start and stop instructions to the remote controller corresponding to the passenger conveyor grouped into the non-automatic start and stop group.

15. The control method according to claim 14, wherein the remote camera continues to capture images of the external state of the passenger conveyor grouped into the non-automatic start and stop group in real time;

when the monitoring server determines that there are no passengers on the passenger conveyor grouped into the non-automatic start and stop group based on the image, the monitoring server sends the start and stop instruction, the remote controller receives the start and stop instruction and controls the start and stop of the passenger conveyor.

16. The control method according to claim 13, wherein the monitoring server sends start and stop instructions to the remote controller corresponding to the passenger conveyor grouped into the automatic start and stop group, and the remote controller receives the start and stop instructions and controls the start and stop of the passenger conveyor.

17. The control method according to claim 13, wherein the alarm device is arranged to give an alarm to the passenger, so as to prompt the passenger to leave the passenger conveyor or not enter the passenger conveyor within a certain time range.

18. The control method according to claim 17, wherein after the alarm device sends out the alarm for a certain time, the remote camera continues to capture images of the external state of the passenger conveyor grouped into the automatic start and stop group in real time;

when the monitoring server determines that there are no passengers on the passenger conveyor grouped into the automatic start and stop group based on the image, the monitoring server sends the start and stop instruction, the remote controller receives the start and stop instruction and controls the start and stop of the passenger conveyor;

when the monitoring server determines that there are passengers on the passenger conveyor grouped into the automatic start and stop group based on the image, the monitoring server will not issue the start and stop instructions.

19. The control method according to claim 16, wherein after the monitoring server sends the start instruction and the remote controller receives the start instruction and controls the start of the passenger conveyor, if the remote controller determines that the passenger conveyor has not accelerated to the normal operation speed, the passenger conveyor is grouped into the non-automatic start group;

after the monitoring server issues a stop instruction and the remote controller receives the stop instruction and controls the passenger conveyor to stop, if the remote controller determines that the passenger conveyor has not slowed down or stopped, the passenger conveyor is grouped into non-automatic stop group;

if the remote controller determines that the passenger conveyor accelerates to the normal operation speed or if the remote controller determines that the passenger conveyor decelerates or stops, the data transmission unit is set to receive the state data about the current operation state of the corresponding passenger conveyor collected by the remote controller;

if the data transmission unit transmits the state data to the monitoring server, the control system prepares the next corresponding auto start and auto stop operation;

if the data transmission unit does not transmit the state data to the monitoring server, the corresponding passenger conveyors are grouped into the non-automatic start and stop group.

20. The control method according to claim 19, wherein said monitoring server includes a human-computer interaction device, said human-computer interaction device being used to display said state data.

* * * * *